United States Patent [19]

Salyer et al.

[11] Patent Number: 4,588,510

[45] Date of Patent: May 13, 1986

[54] INTUMESCENT FIRE EXTINGUISHING SOLUTIONS

[75] Inventors: Ival O. Salyer, Dayton; Charles W. Griffen, Mason; Donovan S. Duvall, Kettering, all of Ohio

[73] Assignee: University of Dayton, Dayton, Ohio

[21] Appl. No.: 587,103

[22] Filed: Mar. 7, 1984

[51] Int. Cl.[4] ..... A62C 1/12; A62C 1/16; A62D 3/12

[52] U.S. Cl. ..... 252/5; 106/18.11; 106/18.14; 106/18.15; 106/18.16; 169/46; 169/47; 169/65; 169/69; 252/3; 252/4; 252/7; 252/350; 252/606

[58] Field of Search ..... 106/15.05, 18.11, 18.14, 106/18.15, 18.16; 252/2, 3, 5, 4, 7, 606, 307, 350; 169/68, 69, 65, 46, 47; 428/920, 921

[56] References Cited

U.S. PATENT DOCUMENTS

| | | | |
|---|---|---|---|
| 2,529,211 | 11/1950 | Busse et al. | 252/3 |
| 3,955,987 | 5/1976 | Schaar et al. | 106/177 |
| 4,076,540 | 2/1978 | Stossel | 252/2 |
| 4,210,452 | 7/1980 | Nicholson et al. | 252/606 |
| 4,221,837 | 9/1980 | Nicholson et al. | 252/606 |
| 4,247,435 | 1/1981 | Kasten | 106/18.16 |

FOREIGN PATENT DOCUMENTS

| | | | |
|---|---|---|---|
| 0756416 | 3/1971 | Belgium | 252/3 |
| 0146172 | 11/1980 | Japan | 252/3 |
| 0066275 | 6/1981 | Japan | 252/3 |

*Primary Examiner*—Stephen J. Lechert, Jr.
*Assistant Examiner*—Howard J. Locker
*Attorney, Agent, or Firm*—Biebel, French & Nauman

[57] ABSTRACT

An aqueous solution useful in extinguishing fires is disclosed comprising diammonium phosphate, a water soluble polyol, a water soluble gas-generating agent, a non-combustible viscosity builder and water; when sprayed upon burning surfaces, the solution intumesces and generates a flame-resistant polymeric foam having a high char value; the foam shuts off the air supply to the burning surface and thereby quickly and effectively extinguishes the fire.

27 Claims, No Drawings

INTUMESCENT FIRE EXTINGUISHING SOLUTIONS

BACKGROUND OF THE INVENTION

The present invention relates to intumescent compositions and, more particularly, to an aqueous-based intumescent solution which is useful in extinguishing fires that can be used as a liquid fire-extinguishing medium in a fire extinguisher.

Aqueous-based intumescent compositions have been used to protect flammable surfaces from heat and flame. The function of these compositions has been primarily insulative. The compositions have not been used to extinguish an already burning fire. Rather, the coatings have been applied to substrates, such as wall board, and dried, such that in the event of fire or intense heat flux the coatings react and generate a foam having a high char value which insulates the substrate and prevents it from burning.

One aqueous-based intumescent composition that has been used to form protective flame-proof coatings is described in U.S. Pat. No. 3,955,987 to Schaar et al. That composition is a film forming composition and contains a polyol, a phosphate source, and a gas-generating agent and produces a flame-resistant polymeric foam upon heating. Typical examples of the phosphate sources disclosed in the Schaar et al patent are monoammonium phosphate, diammonium phosphate and an ammonium polyphosphate sold by Monsanto Company under the trademark PHOSCHECK P/30. In certain embodiments, coatings containing one or more of these phosphate sources, sucrose, cyanoguanidine, titanium dioxide and a polymeric film former react to produce a flame-resistant polymeric foam which protects the underlying substrate upon exposure to flames. Kasten, U.S. Pat. No. 4,247,435 discloses a related class of intumescent coatings containing a chelating agent to impact viscosity stability to the composition, i.e., to prevent viscosity from increasing over time.

Previous aqueous-based intumescent compositions and particularly the compositions described in the Schaar et al patent are not true solutions and, consequently, are not desirable for use in fire extinguishers. The intumescent compositions described in the Schaar et al patent are thixotropic supersaturated suspensions containing insoluble components that tend to settle out over short periods of time. Consequently, they cannot be readily dispensed by pumping and they are not useful as the fire extinguishing medium in fire extinguishers. To be useful in fire extinguishers, intumescent compositions must be capable of coating a burning object, intumescing and generating a fire-resistant foam which shuts off the air supply to the burning object. There is no indication in Schaar et al or the prior art that this function can be achieved within the compositional restraints of a true solution. To the contrary, prior art compositions are designed to be applied as a permanent or temporary intumescent paint in advance of a fire. On the other hand, an aqueous intumescent solution would be a very desirable fire extinguishing medium because it would be storage stable, readily pumpable, and the water itself would help extinguish the fire.

Thus, there is a need for an intumescent aqueous solution that is useful in extinguishing fires.

SUMMARY OF THE INVENTION

The present invention has for its principal object providing an aqueous solution which can be sprayed onto a fire where it intumesces and generates a flame-resistant polymeric foam that will extinguish the fire. This is accomplished by providing a solution of a phosphate source, a polyol, and a gas generating agent having a viscosity that enables it to coat a burning object and containing concentrations of reactants that enable a foam-forming polymer to be built and foamed in situ under less than ideal conditions.

Accordingly, one embodiment of the present invention is an intumescent solution suitable for use in a fire extinguisher and in extinguishing fires which has a viscosity greater than 100 cps at 25° C. and comprises about 10 to 30% by weight diammonium phosphate, about 15 to 35% by weight of a water soluble polyol which is capable of reacting with phosphoric acid and generating a flame-resistant, air excluding foam, about 0.5 to 25% by weight of a water soluble thermally activated gas-generating agent, about 5 to 25% by weight of urea or an equivalent non-combustible viscosity builder, optionally up to about 5% by weight of a water soluble, salt-tolerant surfactant which assists foaming by reducing surface tension, and about 30 to 60% by weight water.

Another embodiment of the present invention resides in a fire extinguisher comprising a vessel containing the intumescent solution described above and means for pumping the solution from the vessel and spraying it upon a fire.

Still another embodiment of the present invention resides in a process for extinguishing fires which comprises spraying the aforementioned solution onto a burning fire in an amount sufficient to extinguish it.

The intumescent solutions of the present invention are particularly desirable because being true solutions, they are storage-stable at ordinary ambient temperatures for long periods of time. Furthermore, they can be readily dispensed using gas pressure from standard extinguishers. They do not clog the dispenser nozzle. They do not generate smoke or toxic fumes when sprayed onto a fire and they are suitable for use in closed environments such as homes, automobiles and boats.

The solutions of the present invention are also desirable because they can effectively penetrate porous objects and thereby extinguish fires that burn beneath the surface. The coating and encrusting features of the polymeric foams generated by the solutions prevent re-ignition and flashback. They are also advantageous because, being water based compositions, the residues remaining after the fire is extinguished can be removed by water washing. These residues are also non toxic and not environmentally unacceptable.

The intumescent solutions of the present invention are useful in extinguishing Class A solid fuel fires and Class B liquid fuel fires. They are particularly useful in extinguishing fires involving porous materials such as straw, cotton batting and upholstery. The water solutions of the present invention can carry the intumescent polymer forming reagents into burning porous substrates where they foam and extinguish the fire beneath the surface of the substrate. Therefore, they are more advantageous than other extinguisher compositions which do not provide good penetration and which can allow burning to continue beneath the surface of a body. The water carrier also adds to the fire extinguishing capability of the system by wetting and cooling burning surfaces.

The solutions of the present invention can be used to extinguish Class B liquid-fuel fires. Being aqueous based solutions, however, the solutions of the present invention will not float on most liquid fuels. Consequently, solutions designed for use on Class B fires contain a foaming agent which enables the solution to be foamed by air entrainment as it is dispensed. In this manner, the solution can be sprayed in foam form onto a liquid fuel where it floats such that the heat of the liquid fuel fire will trigger intumescence and polymerization and generate a flame-resistant air excluding foam which extinguishes the fire.

Additionally, the solutions of the present invention can be used in the more conventional fashion and sprayed on combustible surfaces to prevent them from being ignited by an adjacent fire.

DETAILED DESCRIPTION OF THE INVENTION

The intumescent solutions of the present invention are characterized in that they are true aqueous solutions having predetermined viscosities and containing amounts of intumescent reactants which enable them to coat a burning object, intumesce and generate a flame-resistant foam which seals the burning surface from the air. The principal reactions of the solution of the present invention are in situ polymerization of a phosphate source and a polyol which generates a flame-resistant polymer having a high char value and foam formation by pneumatogens generated by a gas forming agent in the solution. As a result, a foam is generated which excludes air from the surface of a burning object.

The intumescent solutions of the present invention contain diammonium phosphate as a principal phosphate source. Upon heating in the presence of a polyol, such as a reducing sugar, phosphoric acid generated by the phosphate source reacts with the polyol to produce a heat and fire-resistant polyester in situ.

Diammonium phosphate is preferred for use in the present invention due to its high water solubility. Although monoammonium phosphate is generally considered a more efficient phosphate source in that it provides more phosphoric acid per unit weight, it is not the primary phosphate source used in the present invention because of its relatively low water solubility. True solutions having adequate foam-forming ability to extinguish a burning fire cannot be formed using monoammonium phosphate alone. However, minor amounts of monoammonium phosphate can be used advantageously in combination with a larger percentage of diammonium phosphate.

The intumescent solutions of the present invention usually contain approximately 10 to 35% by weight diammonium phosphate and, more preferably, about 15 to 20% by weight. The lower concentration limit generally represents a minimum amount of phosphate which is capable of reacting with polyol and building a polymer in situ. The higher concentration generally represents the solubility limit of diammonium phosphate.

If desired, the foam-forming ability of the solution can be enhanced by adding other phosphate sources to the solution. Monoammonium phosphate can be added in an amount up to about 7% by weight or its solubility limit. One or more water soluble phosphate salts such as potassium phosphate and sodium phosphate may also be used. Similarly, other less soluble phosphate sources can be used provided they are not used in amounts exceeding their solubility limits.

The polyols used in the present invention are water soluble and have a high hydroxyl number. They can generally be characterized as containing about 2 to 12 carbon atoms and 2 to 8 hydroxyl groups. Preferred polyols are soluble in water in an amount of at least 0.1 g/ml at 23° C. and have a hydroxyl number of at least 2. Some of the most cost effective polyols for use in the present invention are sugars including monosaccharides and disaccharides including sucrose, dextrose glucose, fructose, etc. Confectioners grade of ordinary cane sugar can be used in many applications because the sugar is dissolved more rapidly. Glycerine is also a useful polyol and may be preferred for some applications because of its low fuel content and high solubility in water. Conceivably, ethylene glycol could also be used as the polyol.

Pentaerythritol, pentaglycerine, neopentyl glycol and mixtures thereof can be used in amounts up to their solubility limits. These polyols reversibly absorb large amounts of thermal energy in solid state tranformations and act as a heat sink to reduce temperature. In addition, due to the concentration of hydroxyl groups in the molecules, they are believed to provide a higher degree of cross-linking and thereby generate a more flame-resistant foam having a higher char value. In addition, these polyols all contain a high percentage of oxygen and thus have low fuel content.

The solid state transformation temperatures of pentaerythritol and its related polyols can be adjusted over a wide range of temperatures by using the polyols in combination and varying the molar ratio. Some useful combinations are pentaerythritol and pentaglycerine and pentaerythritol and neopentyl glycol in mole ratios ranging from 10 to 90 molar % pentaerythritol.

The amounts of phosphate source(s) and polyol(s) in the solution are adjusted to provide a reaction system having in situ foam-forming ability. Because the polyol and phosphate sources each contain two or more functional groups, they can be used over a fairly wide concentration range within their solubility limits to generate the requisite foam. Generally the polyol and phosphate source are used in approximately stoichiometric amounts. Since the polyols are carbonaceous and therefore combustible, it is generally not desirable to use them in an amount more than required to generate the desired foam forming polymer. Typically, the intumescent solutions of the present invention contain about 15 to 35% by weight polyol and more specifically about 20 to 30% by weight.

A thermally activated gas-generating agent is included in the intumescent solutions of the present invention to foam the reaction product of the phosphate and the polyol upon heating. The gas-generating agents of choice are thermally decomposing compounds which produce non-flammable pneumatogens such as nitrogen. Cyanoguanidine is preferred, but other compounds such as azobisisobutyronitrile, nitroso compounds such as dinitrosopentamethylenetetramine, ammonium citrate, ammonium tartrate, etc. are also believed to function satisfactorily.

The gas-generating agent is used in an amount sufficient to foam the fire-resistant polyester. The amount will vary depending on the agent selected and its ability to generate pneumatogens per unit weight. In the most typical embodiments of the present invention, about 0.5 to 5% by weight of a gas-generating agent such as cyanoguanidine provides adequate foaming ability.

The water present in the solutions of the present invention has the capacity to function as a gas-generating agent (steam), however, solutions containing water alone as the pneumatogen are only functional on very limited fires. Consequently, the use of a thermally activated gas-generating agent in addition to water is required for most applications.

One of the most important considerations in designing intumescent solutions useful as fire extinguishers is the viscosity and, more particularly, the minimum viscosity of the solution. As pointed out above, to be effective fire extinguishing compositions, the solutions must be capable of coating a burning object. If the solutions are too thin (i.e., have too low viscosity) they will run off the burning substrate and not adequately coat it. As a result, the foam generated will probably not be sufficiently thick to shut off the supply of air to the surface of the burning object. For this reason, it is important that the solutions of the present invention have a viscosity of at least 100 cps as measured at 25° C. The upper limit on the solution viscosity is less critical. If the viscosity of the solution is too high, it may be difficult to pump from a particular extinguisher apparatus. As such, the upper limit on the viscosity of the solutions of the present invention is primarily a function of the extinguisher apparatus with which they will be used. For most hand held extinguishers, viscosities up to 10,000 cps are satisfactory. The present invention, however, is not limited to solutions having less than the latter viscosity since higher viscosity solutions can be used particularly in conjunction with positive pumping equipment such as is used on many fire trucks. Generally, viscosities in the range of about 200 to 1000 cps at 25° C. are preferred.

The viscosity of the solutions of the present invention can be adjusted by the addition of a water soluble, noncombustible, viscosity builder. Urea has been found to be excellent for this purpose. It is inexpensive and noncombustible and can be used to increase the viscosity of the formulation and thereby form a thicker coating and enhance the ability of the solution to cover a burning surface. When urea is used in the present invention, it is desirably employed in an amount of about 5 to 25% by weight and, more preferably, about 9 to 16% by weight. Typically this amount of urea provides a solution having a viscosity in the range of about 400 to 1000 cps at 25° C.

The solutions of the present invention are generally formulated with about 30 to 60% water. The water functions as a solvent for the intumescent polymer forming components and is an effective heat sink. It is important that the formulation not be so dilute that the reactants do not polymerize in situ and intumesce effectively. The preferred solutions contain about 40 to 50% by weight water.

As previously indicated, the intumescent solutions of the present invention are useful in extinguishing Class A and Class B fires. For use on Class B fires, however, it is necessary to foam the solution as it is dispensed to reduce its density such that it will float on liquid fuels. For this purpose, a foaming aid or surfactant is incorporated in the solution which reduces surface tension. Due to the high concentration of phosphates in the solution, it is necessary that the surfactant used be salt-tolerant. Anionic, nonionic and cationic surfactants are useful. One surfactant that has been found to be particularly useful is Witconate AOS a nonionic surfactant available from Witco Chemical Co.

While the use of this surfactant will not interfere with the intumescent foaming which occurs upon heating, the principal function of the surfactant is to assist in physical foam formation upon dispensing the solution. Consequently, the surfactant is optional in extinguishers designed solely for extinguishing Class A fires but is desirably included to provide a solution that can be used in either capacity.

The amount of surfactant used will vary from 0 in the case of a solution designed solely for use on Class A fires, to about 5% for a readily foamable solution for use on Class A or Class B fires.

The present invention is illustrated more specifically by the non-limiting examples of solution formulations in accordance with the present invention shown in the Table below:

TABLE

| Component | Compositions (wt. %) (1) | (2) | (3) | (4) |
|---|---|---|---|---|
| 1. Monoammonium Phosphate (MAP) | — | 6.72 | — | — |
| 2. Diammonium Phosphate (DAP) | 15.14 | 16.14 | 16.14 | 16.14 |
| 3. Sugar (sucrose) | 26.90 | 20.18 | 20.18 | — |
| 4. Glycerine | — | — | — | 20.18 |
| 5. Cyanoguanidine | 1.61 | 1.61 | 1.61 | 1.61 |
| 6. Urea | 9.14 | 9.14 | 15.86 | 15.86 |
| 7. Witconate AOS | 2.20 | 2.20 | 2.20 | 2.20 |
| 8. Water | 44.01 | 44.01 | 44.01 | 44.01 |

In certain applications it may be desirable to add low density fillers to the solutions of the present invention prior to application. For example, instead of foaming the solution as it is dispensed for application to Class B fires, low density microballoons can be incorporated into the solution to provide a suspension which will float on liquid fuels. Similarly, in some applications it may be desirable to incorporate a heat-reflective agent such as $TiO_2$ or $ZrO_2$.

The intumescent solutions of the present invention can be used in conventional fire extinguisher equipment including both hand held extinguishers and positive pumping extinguishers. Typical extinguishers include a pressurized vessel in which the solution is contained, means for filling the vessel, a pressure indicator, a shut off valve and a dispensing orifice. In most cases, modern extinguishers include a pressurized gas such as nitrogen or carbon dioxide. For use on class B fires, the extinguisher must additionally include means for foaming the solution as it is dispensed such as an air entraining orifice. Of course, the solutions of the present invention can also be dispensed using pump-type dispensing equipment.

Having described the invention in detail and by reference to specific embodiments thereof, it will be apparent that numerous modifications and variations are possible without departing from the spirit and scope of the following claims.

What is claimed is:

1. A true, aqueous solution capable of intumescing upon exposure to intense heat flux or flame and extinguishing fires comprising about 10 to 30% by weight diammonium phosphate, about 15 to 35% by weight of a water soluble polyol capable of reacting with phosphoric acid and generating a flame-resistant polyester foam, said polyol having 2 to 12 carbon atoms and 2 to 8 hydroxyl groups, about 0.5 to 25% by weight of water soluble, thermally activated gas-generating agent, said gas-generating agent producing a non-flammable pneumatogen upon heating, 0 to about 5% by weight of a water soluble, salt-tolerant surfactant, and about 30 to 60% by weight water, said solution having a viscosity in excess of about 100 cps at 25° C.

2. The solution of claim 1 wherein said solution contains about 5 to 25% by weight of a non-combustible, water soluble viscosity builder.

3. The solution of claim 2 wherein said solution additionally contains up to 7% by weight monoammonium phosphate.

4. The solution of claim 3 wherein said non-combustible viscosity builder is urea.

5. The solution of claim 4 wherein said gas-generating agent produces nitrogen upon exposure to heat.

6. The solution of claim 5 wherein said polyol is a sugar.

7. The solution of claim 5 wherein said polyol is glycerine.

8. The solution of claim 5 wherein said polyol is selected from the group consisting of pentaerythritol, pentaglycerine, neopentyl glycol, and mixtures thereof.

9. The solution of claim 6 wherein said gas-generating agent is cyanoguanidine.

10. The solution of claim 7 wherein said gas generating agent is cyanoguanidine.

11. The solution of claim 8 wherein said gas generating agent is cyanoguanidine.

12. The solution of claim 1 wherein said solution contains a water soluble, salt-tolerant surfactant.

13. The solution of claim 1 wherein said polyol is selected from the group consisting of monosaccharides, disaccharides, glycerine, pentaerythitol, pentaglycerine, neopentyl glycol, and mixtures thereof.

14. A method for extinguishing fires which comprises spraying onto a fire a solution comprising about 10 to 30% by weight diammonium phosphate, about 15 to 35% by weight of a water soluble polyol capable of reacting with phosphoric acid and generating a flame-resistant polyester foam, said polyol containing 2 to 12 carbon atoms and 2 to 8 hydroxyl groups, about 0.5 to 25% by weight of a water soluble, thermally activated gas-generating agent, said gas-generating agent producing a non-flammable pneumatogen upon heating, 0 to about 5% by weight of a water soluble, salt-tolerant surfactant, and about 30 to 60% by weight water, said solution having a viscosity in excess of about 100 cps at 25° C.

15. The method of claim 14 wherein said solution contains about 5 to 25% by weight of a non-combustible, water soluble viscosity builder.

16. The method of claim 15 wherein said solution additionally contains up to 7% by weight monoammonium phosphate.

17. The method of claim 16 wherein said non-combustible viscosity builder is urea.

18. The method of claim 17 wherein said gas-generating agent produces nitrogen upon exposure to heat.

19. The method of claim 18 wherein said polyol is a sugar.

20. The method of claim 16 wherein said polyol is glycerine.

21. The method of claim 18 wherein said polyol is selected from the group consisting of pentaerythritol, pentaglycerine, neopentyl glycol, and mixtures thereof.

22. The method of claim 19 wherein said gas-generating agent is cyanoguanidine.

23. The method of claim 21 wherein said gas-generating agent is cyanoguanidine.

24. The method of claim 14 wherein said polyol is selected from the group consisting of monosaccharides, disaccharides, glycerine, pentaerythitol, pentaglycerine, neopentyl glycol, and mixtures thereof.

25. A fire extinguisher including a vessel containing an intumescent fire extinguishing solution and means for dispensing said solution from said vessel and spraying it on a fire wherein said solution comprises about 10 to 30% by weight diammonium phosphate, about 15 to 35% by weight of a water soluble polyol capable of reacting with phosphoric acid and generating a flame-resistant polyester foam, said polyol containing 2 to 12 carbon atoms and 2 to 8 hydroxyl groups, about 0.5 to 25% by weight of a water soluble, thermally activated gas-generating agent, said gas-generating agent producing a non-flammable pneumatogen upon heating, 0 to about 5% by weight of a water soluble, salt-tolerant surfactant, and about 30 to 60% by weight water, said solution having a viscosity in excess of about 100 cps at 25° C.

26. The fire extinguisher of claim 25 wherein said polyol is selected from the group consisting of monosaccharides, disaccharides, glycerine, pentaerythitol, pentaglycerine, neopentyl glycol, and mixtures thereof.

27. A method for extinguishing liquid-fuel fires which comprises physically foaming a solution comprising about 10 to 30% by weight diammonium phosphate, about 15 to 35% by weight of a water soluble polyol capable of reacting with phosphoric acid and having 2 to 12 carbon atoms and 2 to 8 hydroxyl groups, about 0.5 to 25% by weight of a water soluble, thermally activated gas-generating agent, said gas-generating agent producing a non-flammable pneumatogen upon heating up a water soluble, salt-tolerant surfactant in an amount up to about 5% by weight, and about 30 to 60% by weight water, said solution having a viscosity in excess of about 100 cps at 25° C.; and spraying said physically foamed solution onto a liquid-fuel fire, said physically foamed solution floating upon said liquid-fuel fire and intumescing as said fire heats said solution.

* * * * *